United States Patent [19]

Baker

[11] 4,210,093

[45] Jul. 1, 1980

[54] COUNTING DEVICE

[76] Inventor: Richard A. Baker, 788 Woods La., Grosse Pointe Woods, Mich. 48236

[21] Appl. No.: 953,483

[22] Filed: Oct. 23, 1978

[51] Int. Cl.[2] ..... G06C 1/00

[52] U.S. Cl. ..... 116/222; 35/32; 273/DIG. 26

[58] Field of Search ..... 35/23 A, 32, 33; 116/222, 225; 273/148, DIG. 26; 235/123, 68, 18, 1 B

[56] References Cited

U.S. PATENT DOCUMENTS 3,387,392 6/1968 Kurz ..... 35/33

3,811,205 5/1974 Pitzler ..... 35/32

FOREIGN PATENT DOCUMENTS 179113 7/1954 Austria ..... 35/33

604304 9/1978 Switzerland ..... 35/32

*Primary Examiner*—John W. Shepperd

*Attorney, Agent, or Firm*—Whittemore, Hulbert & Belknap

[57] ABSTRACT

A counting device comprising a series of beads strung on a pair of flexible linear elements or cords. The beads can be moved up and down on the braided cords and will remain in adjusted position along the length of the cords.

3 Claims, 3 Drawing Figures

COUNTING DEVICE

This invention relates generally to a counting device and refers more particularly to a bead-type counting device.

The counting device of this invention may be used for any purpose but is particularly adapted for use as a "score-minder" to keep track of the number of strokes a golfer takes for a hole.

The counting device may be clipped onto a golf bag or golf cart, and comprises a series of beads strung on a pair of cords so that the beads may be moved up or down on the cords and will stay in any adjusted position.

DETAILED DESCRIPTION

Figure 1:
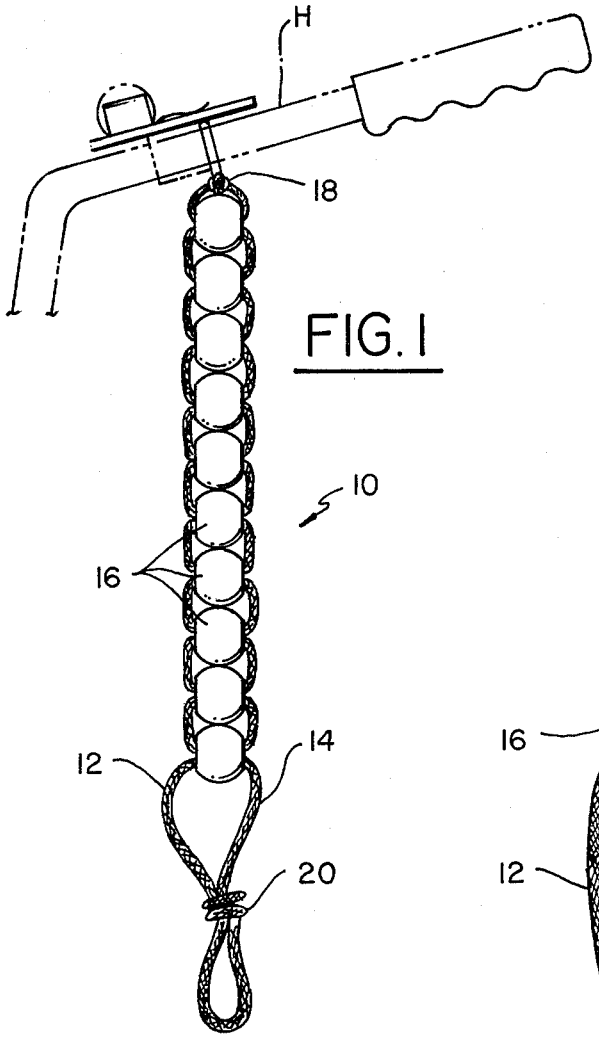
FIG. 1 is an elevational view of a counting device constructed in accordance with my invention and shown clipped to the handle of a golf cart.

Referring now more particularly to the drawing, the counting device is generally designated 10 and comprises a pair of flexible linear elements or cords 12 and 14 and a plurality of beads 16 strung on the cords. The beads may be of any suitable material, such as wood for example. The cords likewise may be of any suitable material but preferably are of a braided fibrous material.

The two linear elements 12 and 14 may actually be a part of a single member formed in a closed loop. As shown, the upper ends of the cords are knotted or tied together where indicated at 18 and the lower ends are also knotted or tied together where indicated at 20.

Figure 3:
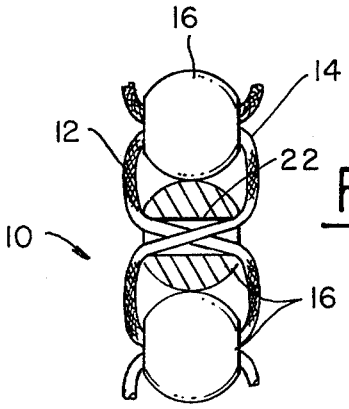
FIG. 3 is a fragmentary view partly in section.

The beads are strung on the two cords in a linear series or sequence as shown, in a manner permitting them to be slid along the length of the cords but frictionally held in adjusted position. Each bead has a hole 22 extending diametrically therethrough. The two braided cords extend through the hole in each bead. As seen in FIG. 3, one cord passes through the hole in a bead from left to right while the other cord passes through the hole in the same bead from right to left. Each cord passes through the holes in the sequence of beads alternately in one direction and the other. In other words, referring again to FIG. 3, while the cord 12 passes from left to right through the middle bead, it passes from right to left through the upper and lower beads. This same alternation in the direction of passage through the holes in the beads applies to the other cord 14.

The cords are rather closely confined in the hole in each bead so as to be in contact with the wall of the hole and with each other and thus to frictionally hold the bead in any given position of adjustment. A braided cord of fibrous material is preferred to increase the amount of frictional contact.

Figure 2:
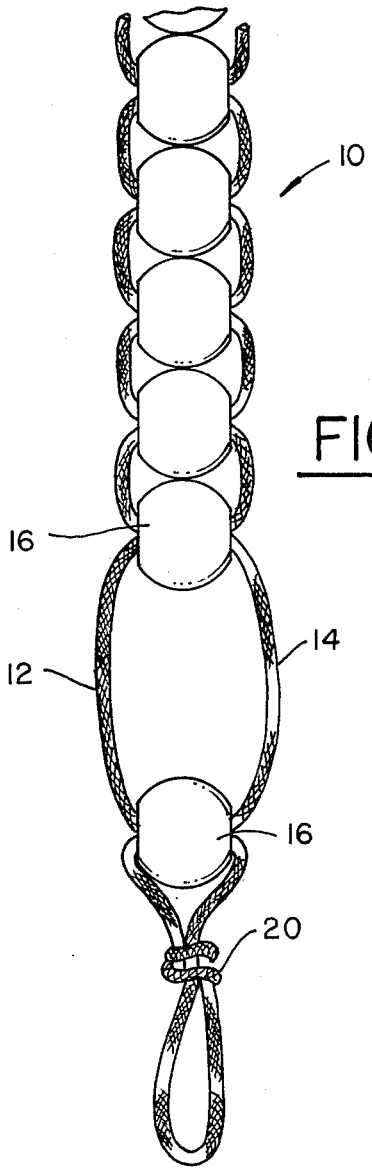
FIG. 2 is an enlarged fragmentary view showing a portion of the counting device of FIG. 1 in which the lowermost bead has been moved down to a position separated from the other beads.

The beads in FIG. 1 are shown pushed tightly together towards the upper end of the counting device, this upper end being shown clipped or in any manner attached to the handle H of a golf cart. The counting device hangs from the handle so that the beads are in a depending series. After the first stroke, the golfer may manually pull the lowermost bead down to the bottom of the counting device as shown in FIG. 2 to separate it from the remaining beads. He will continue to move the beads one by one downward to reflect the number of strokes for a particular hole. At the completion of the hole the golfer can readily count the number of strokes by the position of the beads along the braided cords, after which he will slide all of the beads to the top of the cord in readiness for the next hole.

I claim:

1. A counting device comprising a pair of flexible linear elements, a series of beads strung on said linear elements, each bead having a hole therethrough, each linear element passing through the holes in said beads in sequence, one linear element entering the hole in each bead from one end thereof and the other linear element entering such hole from the other end thereof, each linear element passing through the holes in said beads alternately in one direction and the other, said linear elements together frictionally retaining said beads in any given position along the length thereof.

2. The counting device defined in claim 1, wherein said linear elements are closely confined in the holes in said beads to be in frictional contact with the walls of said holes and with each other.

3. The counting device defined in claim 1 or 2, wherein said linear elements are formed of a braided fibrous material.

* * * * *